US005893458A

United States Patent [19]

Sisk

[11] Patent Number: 5,893,458

[45] Date of Patent: Apr. 13, 1999

[54] ONE-PIECE CUSHIONING CONTAINER FOR CYLINDRICAL OBJECTS

[76] Inventor: John Sisk, 9108 Hale Rd., Hixson, Tenn. 37343

[21] Appl. No.: 08/845,004

[22] Filed: Apr. 22, 1997

Related U.S. Application Data

[63] Continuation of application No. 08/605,281, Feb. 7, 1996, Pat. No. 5,788,077.

[51] Int. Cl.[6] ..... B65D 5/10

[52] U.S. Cl. ..... 206/396; 206/397; 206/493; 206/521; 229/117; 229/157

[58] Field of Search ..... 206/765, 446, 206/521, 784, 389, 395, 396, 397, 408, 493; 229/117, 127, 155

[56] References Cited

U.S. PATENT DOCUMENTS

| | | | |
|---|---|---|---|
| 557,371 | 3/1896 | Ferguson . | |
| 634,647 | 10/1899 | Knobeloch . | |
| 1,829,942 | 11/1931 | Pettibone . | |
| 1,889,933 | 12/1932 | Pratt . | |
| 2,537,151 | 1/1951 | Mires . | |
| 3,158,286 | 11/1964 | Phillips, Jr. . | |
| 3,229,812 | 1/1966 | Metzger . | |
| 3,272,421 | 9/1966 | Perry | 229/117 X |
| 3,371,845 | 3/1968 | Freiman | 229/127 X |
| 3,407,986 | 10/1968 | Manizza . | |
| 3,680,687 | 8/1972 | D'Alessio . | |
| 3,682,597 | 8/1972 | Husch . | |
| 3,747,831 | 7/1973 | Hanson . | |
| 3,790,064 | 2/1974 | Kramer . | |
| 3,836,065 | 9/1974 | Hackenberg . | |
| 3,921,894 | 11/1975 | Hackenberg | 229/117 |
| 4,117,924 | 10/1978 | Growney . | |
| 4,266,716 | 5/1981 | Austin . | |
| 4,416,412 | 11/1983 | Wischusen, III . | |
| 4,509,640 | 4/1985 | Joyce | 229/117 X |
| 4,813,539 | 3/1989 | Church et al. . | |
| 4,817,796 | 4/1989 | Camillo et al. . | |
| 5,141,108 | 8/1992 | Roccaforte . | |
| 5,145,070 | 9/1992 | Pallett et al. . | |
| 5,150,789 | 9/1992 | Bass . | |
| 5,390,790 | 2/1995 | Straub et al. . | |

FOREIGN PATENT DOCUMENTS

| | | |
|---|---|---|
| 0 642 977 A1 | 3/1995 | European Pat. Off. . |
| 525772 | 1/1954 | France . |
| 515914 | 12/1939 | United Kingdom . |
| PCT/US97/01846 | 6/1997 | WIPO . |

*Primary Examiner*—Jacob K. Ackun
*Attorney, Agent, or Firm*—Jones & Askew, LLP

[57] ABSTRACT

A carton of foldable material protects an article packed therein by holding the article away from the bottom of the carton, and preferably by holding the article firmly, yet in a cushioning manner, in a position spaced away from all the exterior walls of the carton. The carton is assembled from a blank of foldable material defining a plurality of spacer panels foldably connected to automatic bottom panels, such that when the carton is erected, the auto-bottom panels form a generally planar bottom of the carton, and the spacer panels extend generally axially into the carton from the bottom to form a two-dimensional support base for holding an object at a location spaced above the bottom of the carton. A top closure includes a clamping member extending into the carton, such that when the carton is closed, the spacer panels and the clamping member are urged against opposite ends of the object within the carton, to hold the object therebetween.

20 Claims, 7 Drawing Sheets

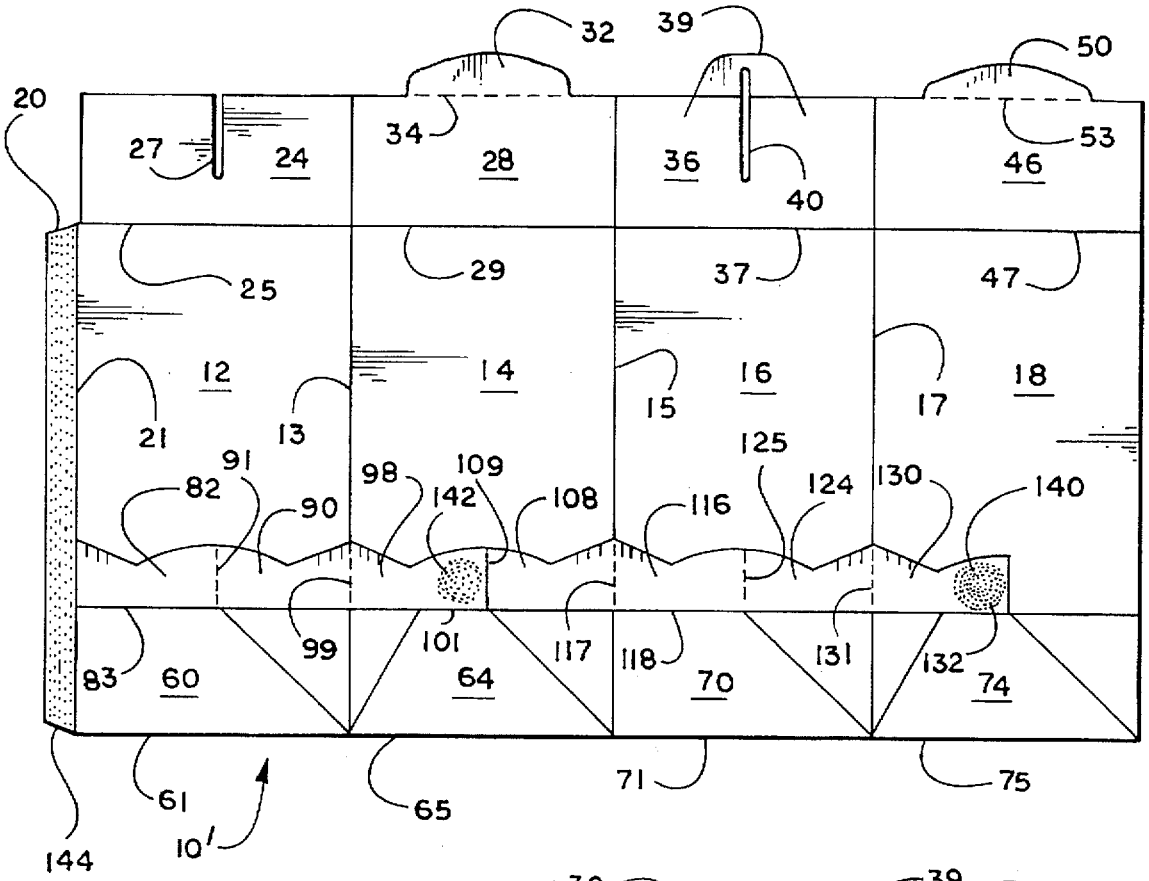
Fig. 2
Fig. 3
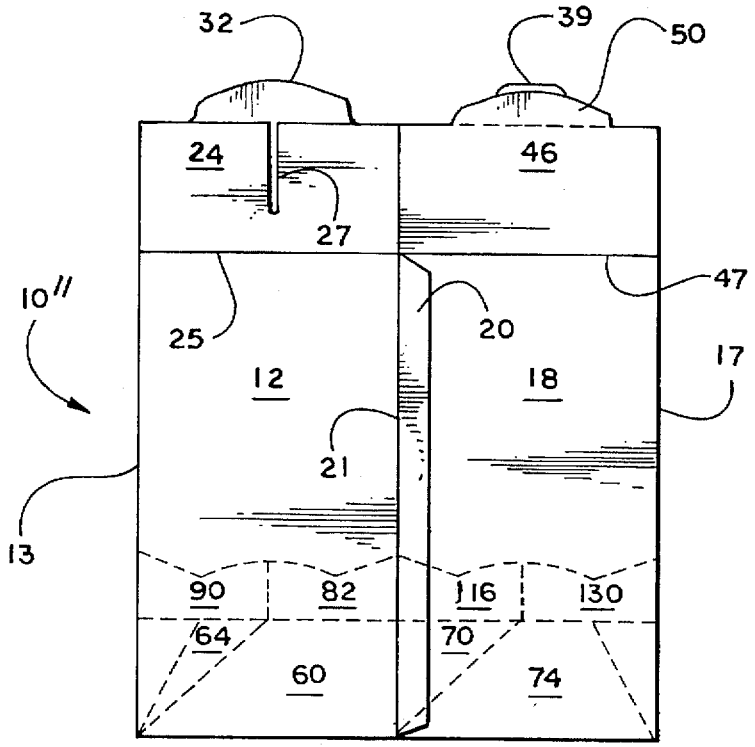

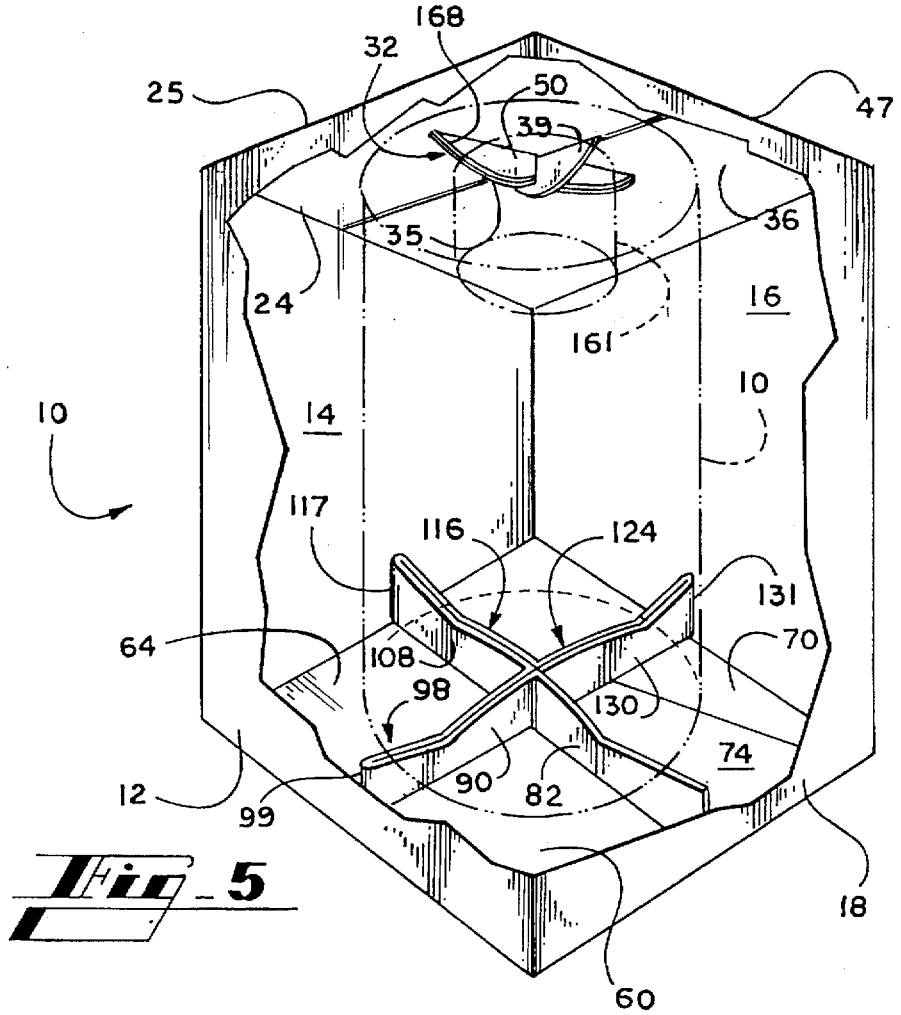
Fig. 5
Fig. 4
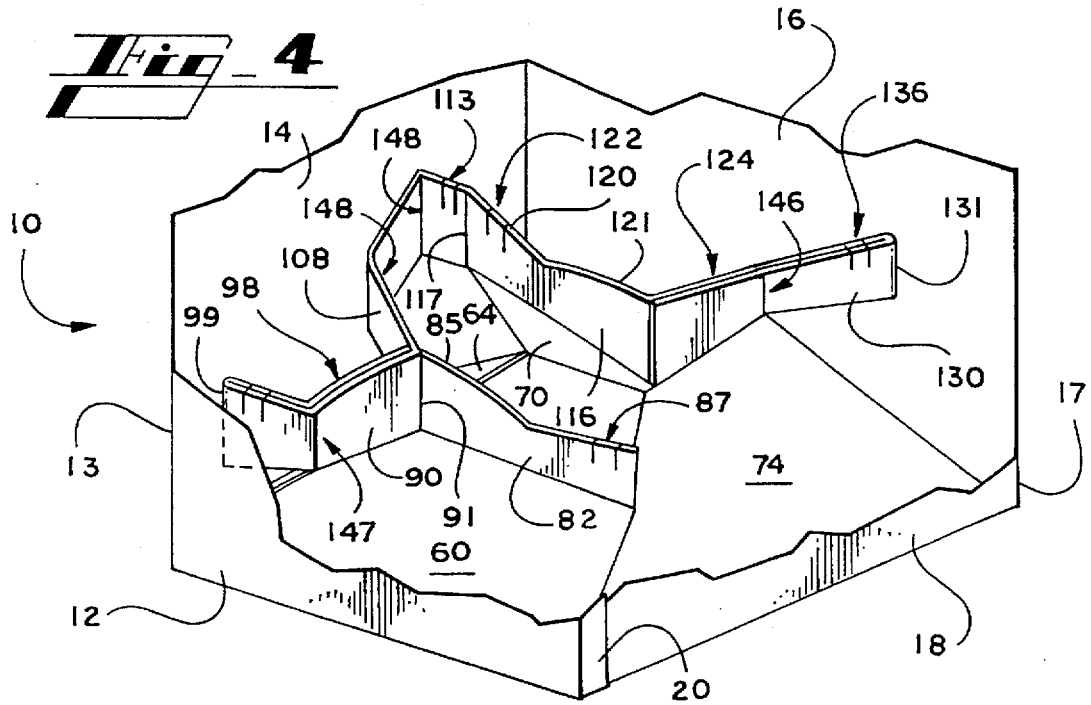

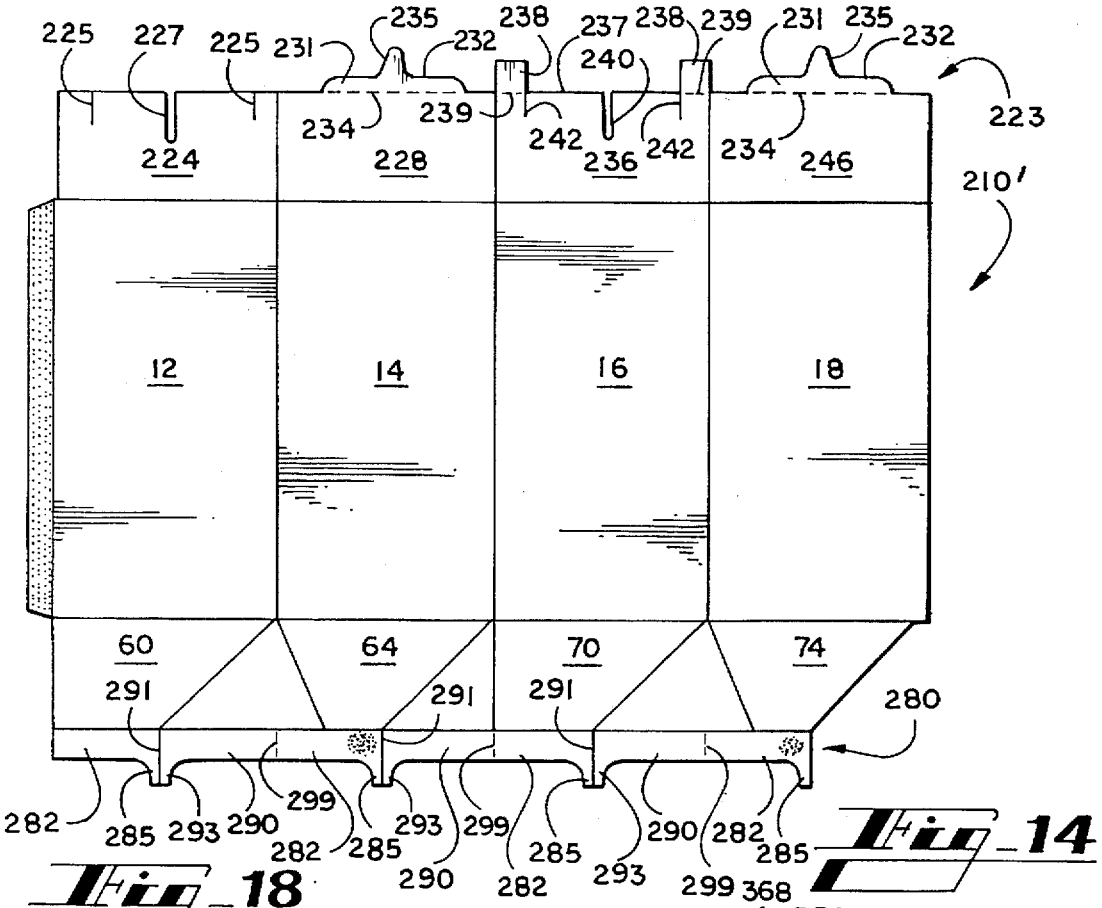
Fig. 14
Fig. 18
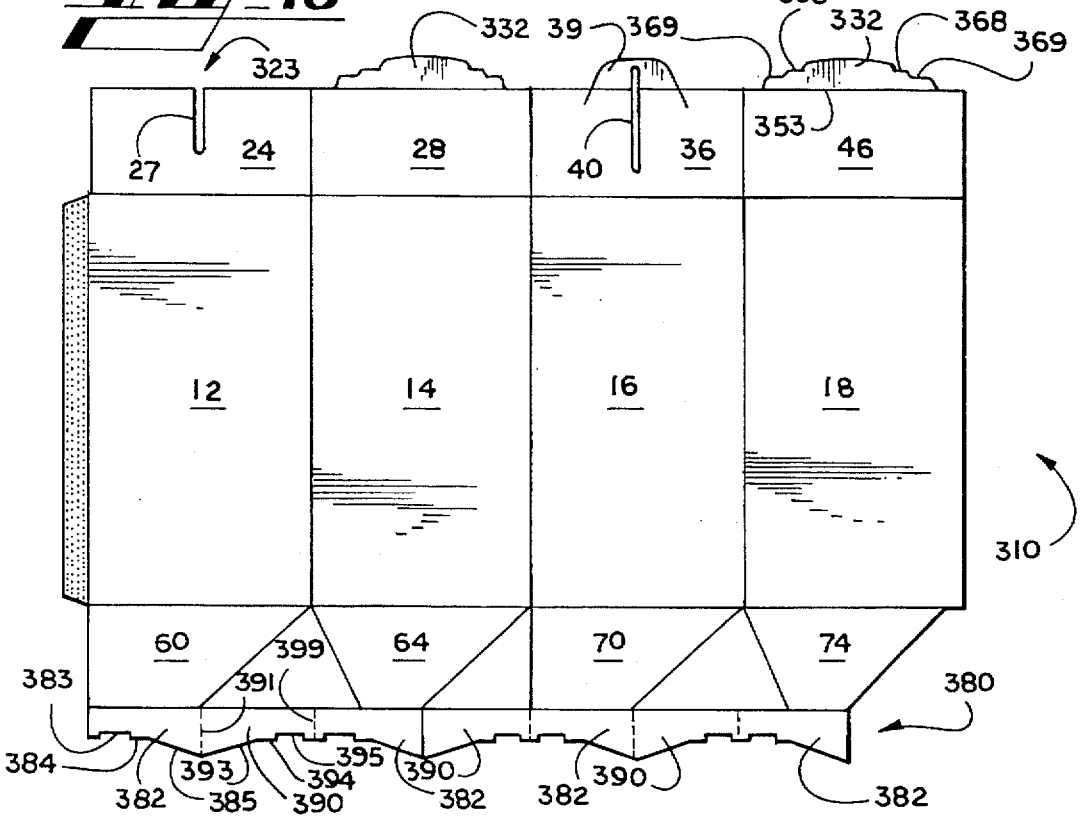

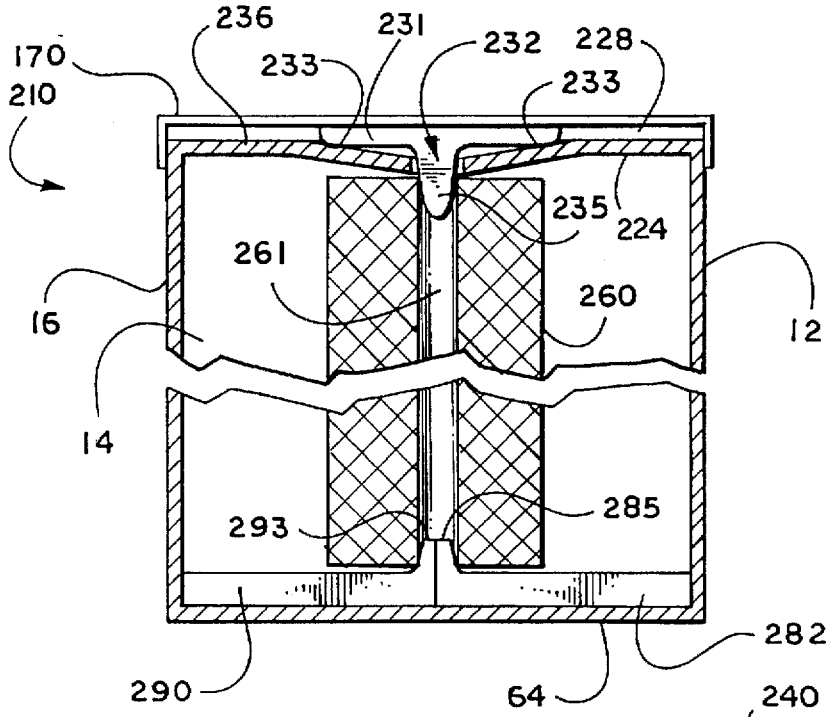
Fig_15
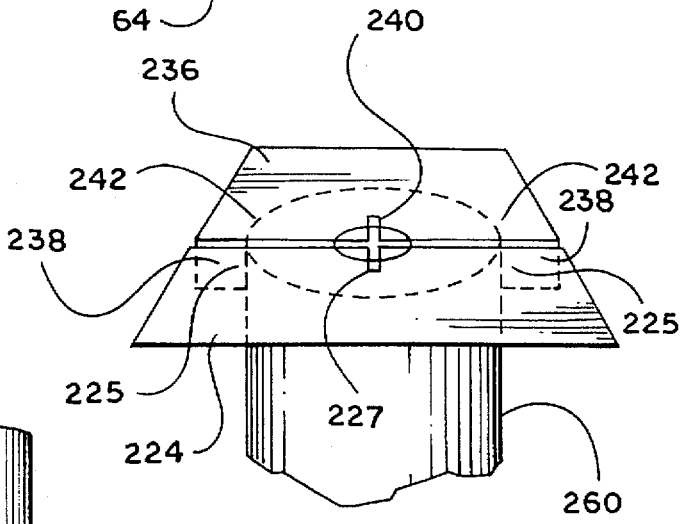
Fig_16
Fig_17
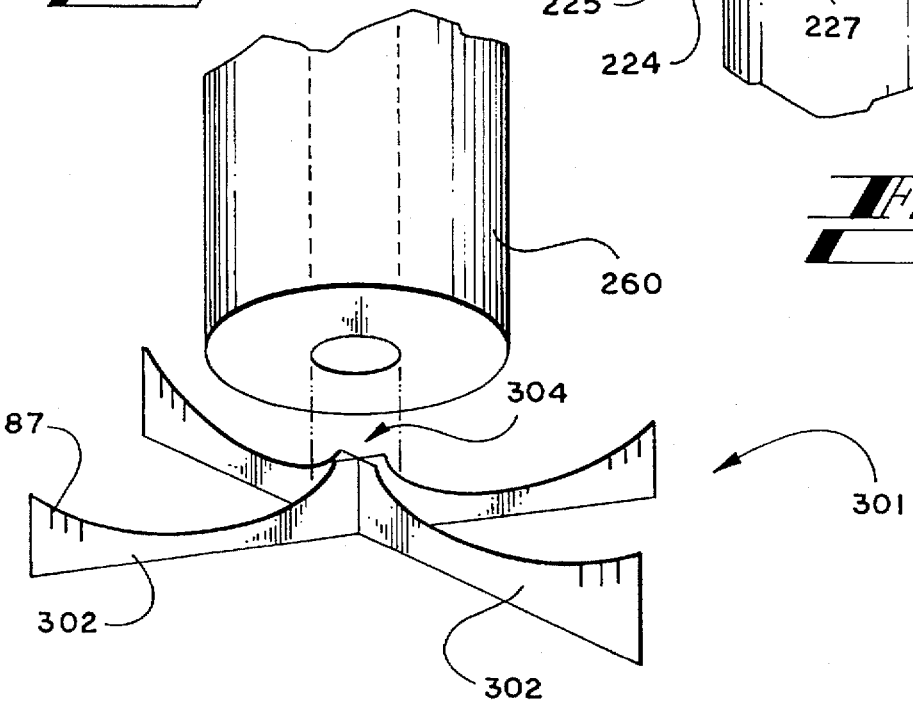

ONE-PIECE CUSHIONING CONTAINER FOR CYLINDRICAL OBJECTS

This is a continuation application Ser. No. 08/605,281 filed Feb. 7, 1996, now U.S. Pat. No. 5,788,077.

TECHNICAL FIELD

The present invention relates to packing cartons, and more particularly relates to a corrugated box within which an object may be protectively centered and secured.

BACKGROUND ART

Many articles of manufacturer must be packaged for shipment by common carrier, and therefore may be subject to rough handling. When such articles are fragile, they must be protected against the possibility that their container may be dropped, battered, or pierced. A common approach to protecting fragile articles is to place the article in a corrugated container surrounded by packing material.

One method has been to use loose fill such as foam "peanuts" or crumpled paper. This method has the disadvantage that the article may be able to migrate through the fill as it vibrates during transport, and eventually find its way to an outer wall of the container where the article is less protected. Another method has been to provide a structural insert such as a molded foam jacket which fits the article and occupies all the remaining space in the carton. Although this method is effective in protecting the article, it is very expensive.

A widespread goal in paperboard and corrugated packaging is to provide all desired structural features of a container from a single flat blank of material. Some prior containers have formed up from a blank with panels extending into the interior of the container, such as shown in U.S. Pat. Nos. 1,829,942; 1,889,933; 3,158,286; 3,229,812; 3,836,065; 4,817,796; and 5,150,789. However, none of these containers position an article away from the exterior walls of the container or cushion it against shock.

Thus, there is a need in the art for a carton, formed from a one-piece blank, that positions an article within the carton, spaced away from the exterior walls, and holds the article firmly in place in a manner which cushions the article if the carton is dropped or impacted. There is a further need in the art for a carton that can protect in this way objects which vary within a range of sizes.

SUMMARY OF THE INVENTION

The present invention seeks to provide a carton of foldable material that can protect an article packed therein by holding the article away from the bottom of the carton, and preferably by holding the article firmly, yet in a cushioning manner, in a position spaced away from all the exterior walls of the carton. The present invention further seeks to provide such a carton that can be utilized for objects within a range of sizes.

In accordance with the invention, these objects are accomplished in a carton assembled from a blank of foldable material defining a plurality of spacer panels foldably connected automatic bottom panels, such that when the carton is erected, the auto-bottom panels form a generally planar bottom of the carton, and the spacer panels extend generally axially into the carton from the bottom to form a two-dimensional support base for holding an object at a location spaced above the bottom of the carton. These objects are further accomplished by providing for the carton a top closure including a clamping member extending into the carton, such that when the carton is closed, the spacer panels and the clamping member are urged against opposite ends of the object within the carton, to hold the object therebetween spaced inwardly from the exterior walls of the carton. The spacer panels and clamping member can be constructed of a compressible material shaped to accommodate objects within a range of sizes.

According to one of its aspects, the present invention provides a carton, comprising a plurality of side panels; a plurality of auto-bottom panels each foldably connected to a bottom edge of one of the side panels; and a plurality of spacer panels foldably connected to at least some of the auto-bottom panels; such that when the carton is erected, the auto-bottom panels form a generally planar bottom of the carton, and the spacer panels extend generally axially into the carton from the bottom to form a two-dimensional support base for holding an object at a location spaced above the bottom of the carton. Preferably, the carton further comprises a top closure foldably connected to one or more of the side panels for enclosing an end of the carton opposite the bottom, the top closure including a clamping member extending into the carton, such that when the carton is closed, the spacer panels and the clamping member are urged against opposite ends of the object within the carton, to hold the object therebetween.

In a preferred embodiment, the top closure may comprise at least one inner cover flap foldably connected to one of the side panels opposite from the carton bottom, the inner cover flap being foldable over an end of the carton, and defining a slot therein at a location spaced inwardly from the side walls; at least one outer cover flap foldably connected to another one of the side panels; and a clamping panel foldably connected along a distal edge of the outer cover flap; the outer cover flap being foldable over the inner cover flap with the clamping flap extending through the slot and generally axially into the end of the carton. The inner cover flap may include an inner mandrel panel folded into the carton and defining an extension of the slot for receiving the clamping panel. In this configuration, the clamping panel and mandrel panel form a cross that can extend down into a cavity of an object having a cavity. Or the cross can form a recess for receiving the article. Likewise, the spacer panels at the bottom of the carton can form a mandrel for entering a cavity or can provide a recess for receiving the article.

According to another of its aspects, the present invention provides a top closure for a carton having a plurality of side walls defining an end of the carton, for packing an object having a central cavity opening to at least one end of the object, comprising a pair of end cover flaps foldably connected to opposite ones of the side panels; and a clamping panel foldably connected to each of the end cover flaps, the clamping panels each defining a convex distal edge; the end cover flaps being foldable over the carton end with the clamping flaps extending together into the end of the carton to engage opposite edges of the cavity in the object with a central portion of the convex edge entering the cavity.

According to yet another of its aspects, the present invention provides a carton for packing an object having a central cavity opening to at least one end of the object, comprising a plurality of side panels; a plurality of auto-bottom panels each foldably connected to a bottom edge of one of the side panels; a plurality of spacer panels foldably connected to at least some of the auto-bottom panels; such that when the carton is erected, the auto-bottom panels form a generally planar bottom of the carton, and the spacer panels extend generally axially into the carton from the bottom; a first inner cover flap extending from a first side panel to define a distal edge part way across an open end of the carton opposite the bottom, and defining a first slot therein intersecting the distal edge; a second inner cover flap extending from a second side panel to a position adjacent to the distal edge of the first inner cover flap; an inner mandrel panel foldably connected to the second inner cover flap, and adapted to be inserted into the carton where the inner cover flaps meet and into the cavity of the object; a second slot beginning in the second inner cover flap and continuing into the inner mandrel panel, the second slot being coplanar with the first slot; an outer cover flap foldably connected to a third one of the side panels; and an outer clamping panel having a convex distal edge foldably connected along a distal edge of the outer cover flap; the outer cover flap being foldable over the inner cover flaps with the outer clamping flap extending through the first and second slots and generally axially into the portion of the second slot defined in the inner mandrel panel; the outer clamping flap engaging opposite edges of the cavity in the object with a central portion of the convex edge entering the cavity.

Other objects, features, and advantages of the present invention will be apparent upon reviewing the following detailed description of a preferred embodiment, when taken in conjunction with the drawings.

BRIEF DESCRIPTION OF THE DRAWING

FIG. 2 is a plan view of the blank of FIG. 1 partly folded.

FIG. 3 is a plan view of the blank FIG. 2 folded and glued to form an assembled but unerected carton, in a flat form for shipping.

FIG. 4 is a pictorial view of the interior of the carton showing the automatic bottom and spacer panels in a partially erected configuration.

FIG. 5 is a pictorial view of the fully erected and closed carton with portions of the walls broken away to show interior detail.

FIG. 14 is a plan view of the interior surface of a blank from which a second embodiment of a carton according to the invention can be assembled.

FIG. 15 is a side cross sectional view showing the cover flaps and spacer panels of the carton of FIG. 14 engaging a cylindrical object.

FIG. 16 is a partial pictorial view showing the relationship of the inner cover flaps of the carton of FIG. 14 with a cylindrical object in the carton.

FIG. 17 is a pictorial view of modified spacer panels suitable for use on the blank of FIG. 14.

FIG. 18 is a plan view of the interior surface of a blank from which a third embodiment of a carton according to the invention can be assembled.

DETAILED DESCRIPTION

Figure 1:
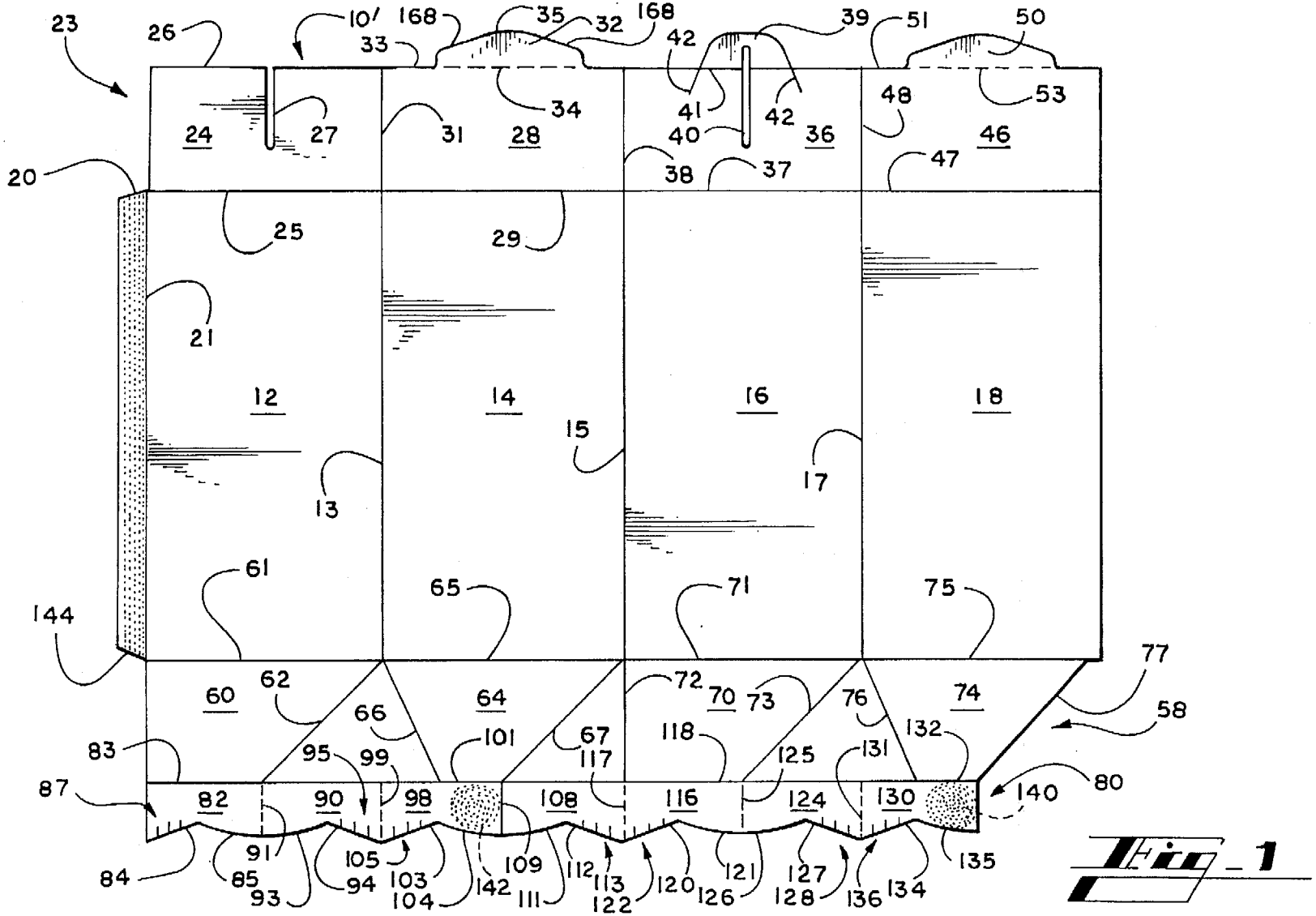
FIG. 1 is a plan view of the interior surface of a blank from which a carton embodying the invention can be assembled.

Referring now in more detail to the drawings, in which like numerals refer to like parts throughout the several views, FIG. 1 shows a blank 10' of a foldable sheet material from which may be formed a carton 10 as shown in FIGS. 4–13. The carton 10 in its erected form is best shown in FIG. 5. As will be explained, the blank 10' may be folded and glued into an intermediate flat form 10" shown in FIG. 3. In this configuration, the cartons may be stacked flat for shipping.

As noted above, the carton 10 is intended to provide protective packaging for articles that can be damaged during shipment. The carton according to the invention accomplishes this by suspending the article within the carton, spaced away from the exterior side and end walls of the carton. The structural components of the carton in its preferred embodiment are formed from the single flat blank 10'. It will be seen by those skilled in the art that multiple pieces of foldable material could also be used.

The structural features which accomplish these objects of the invention are formed from a single-piece blank 10' of foldable material, preferably conventional corrugated paperboard box material. However, a carton according to the present invention can be formed from any foldable and scorable material, such as solid paperboard or plastic sheeting. The blank 10 includes four side wall panels 12, 14, 16 and 18 that are foldably connected along score lines. Score line 13 joins side panels 12 and 14; score line 15 joins side panels 14 and 16; and score line 17 joins side panels 16 and 18, as shown in FIG. 1. An elongate glue flap 20 is joined to the panel 12 along a score line 21, to be used in joining side panel 12 to side panel 18.

A group of flaps form a top closure 23 foldably connected to the side panels. An inner cover flap 24 is connected to the side panel 12 along a score 25. The flap 24 defines a distal edge 26 into which extends a slot 27 midway across the width of the flap 24. An outer cover flap 28 is foldably connected the side panel 14 along a score 29.

A cut line 31, collinear with the score 13, separates the flaps 24 and 28. A clamping panel 32 extends outwardly from a distal edge 33 of the outer cover flap 28, to which the panel 32 is foldably connected along a perforated or jump cut score 34. Such scores include spaced apart slits passing through the blank to weaken the score for ease of bending. The clamping panel 32 defines a convex edge 35 opposite the score 34.

A second inner cover flap 36 is connected to the side panel 16 along a score 37. The flap 36 is separated from the flap 28 by a cut line 38. A mandrel panel 39 extends outwardly from the cover flap 36, to which the panel 39 is foldably connected along a score 41. An elongate slot 40 extends from a point in the mandrel flap 39 parallel to the scores 13, 15, and 17, into the inner cover flap 36, terminating at a point spaced apart from the score 37. The slot 40, like the slot 27, is located midway across the inner cover flap, so that these slots 27 and 40 will be aligned during closure of the carton 10. A pair of cut lines 42 extend from both ends of the edge of the mandrel panel 39 a short distance into the material of the flap 36. The purpose of the cut lines 42 is to allow the axial position of the panel 39 to vary depending on the height of the article being packed or the inside diameter of a central opening of the article. A second outer cover flap 46 is connected to the side panel 18 along a score 47, and is separated from the flap 36 by a cut line 48. A clamping panel 50, similar in shape and position to the clamping panel 32, extends from a distal edge 51 of the flap 46, and is separated from the flap 46 by a jump cut score 53.

Referring still to FIG. 1, a bottom closure 58 is attached to the side panels along the bottom portion of the blank 10'. As will become apparent, the bottom closure 58 is in the nature of an "automatic bottom" closure, which automatically encloses the bottom end of the carton 10 when the carton is erected for loading as explained below. While the mechanism is generally conventional in its operation, the manner in which the automatic bottom panels are connected is unique to the present invention.

A first automatic bottom panel 60 is foldably connected to the side panel 12 along a score 61. The panel 60 defines a cut edge 62 extending diagonally from an end of the score 13. A second automatic bottom panel 64 is foldably connected along the score 65 to the side panel 14. The panel 64 is an irregular trapezoid, defining cut edges 66 and 67, which extend diagonally from ends of the scores 13 and 15, respectively. A third automatic bottom panel 70 is connected to the side panel 16 along a score 71. The panel 70 is shaped similarly to the panel 60 and defines a cut edge 72 extending parallel to the score 15, as well as a cut edge 73 extending diagonally from an end of the score 17. A fourth automatic bottom panel 74 is shaped similarly to the panel 64, and is connected along a score 75 to the side panel 18. The panel 74 defines a cut edge 76 extending diagonally from an end of the score 17, and a cut edge 77 extending diagonally from a point along the score 75 adjacent to the elongate edge of the panel 18. It should be understood that when the blank 10' is cut, there are triangular voids between the panels 60 and 64, 64 and 70, and 70 and 74. Furthermore, the scores 61, 65, 71, and 75 are generally collinear.

The four automatic bottom panels 60, 64, 70, and 74 are connected along the lower periphery of the blank 10' by an elongate strip 80 of spacer panels. The inner edge of the strip 80 may be linear for attachment to the automatic bottom panels, while the outer edge of the strip 80 could be linear but preferably has a particular profile designed according to the type of article to be packaged within the carton 10.

In the preferred embodiment shown, a first spacer panel 82 of the strip 80 is foldably connected to the panel 60 along a score 83, and extends from a left periphery of the blank to the cut edge 62. The spacer panel 82 defines an inwardly inclined outer edge section 84 which extends from the left periphery of the panel 82 to the center thereof, at which point the panel 82 is at its shortest height. From that central point to a jump cut score 91, which meets the cut edge 62, the panel 82 expands in height again and defines an arcuate edge section 85. A plurality of slits 87 are cut generally axially into the inclined edge section 84 to weaken that portion of the spacer panel 82 for a purpose to be described below.

Next along the strip 80 is a second spacer panel 90 connected to the spacer panel 82 by the jump cut score 91. The panel 90 defines an arcuate edge section 93 extending from the score 91. The edge section 93 is a mirror image of the edge section 85 of the panel 82. An inclined edge section 94 extends outwardly from the section 93 to a jump cut score 99 that is located between the automatic bottom panels 60 and 64. Slits 95 similar to slits 87 weaken the inclined edge section 94.

Next along the strip 80 is a third spacer panel 98 connected to the spacer panel 90 by the jump cut score 99, and connected to the automatic bottom panel 64 along a score 101. The panel 98 defines an inclined edge section 103 extending from the score 99. The edge section 103 is a mirror image of the edge section 94 of the panel 90. An arcuate edge section 104 extends from the section 103 to a jump cut score 109 that meets the cut edge 67. Slits 105 similar to slits 87 weaken the inclined edge section 103.

Next along the strip 80 is a fourth spacer panel 108 connected to the spacer panel 98 by the jump cut score 109, and extending between the automatic bottom panels 64 and 70. The panel 108 defines an arcuate edge section 111 extending from the score 109. The edge section 111 is a mirror image of the edge section 104 of the panel 98. An inclined edge section 112 extends from the section 111 to a jump cut score 117, which meets the cut edge 72 of the panel 70. The edge section 112 is a mirror image of the edge section 103' of the panel 98. Slits 113 similar to slits 87 weaken the inclined edge section 112.

Next along the strip 80 is a fifth spacer panel 116 connected to the spacer panel 108 by the jump cut score 117, and connected to the automatic bottom panel 70 along a score 118. The panel 116 defines an inclined edge section 120 extending from the score 117. The edge section 120 is a mirror image of the edge section 112 of the panel 108. An arcuate edge section 121 extends from the section 120 to a jump cut score 125 that meets the cut edge 73. Slits 122 similar to slits 87 weaken the inclined edge section 120.

Next along the strip 80 is a sixth spacer panel 124 connected to the spacer panel 116 by the jump cut score 125. The panel 124 defines an arcuate edge section 126 extending from the score 125. The edge section 126 is a mirror image of the edge section 121 of the panel 116. An inclined edge section 127 extends from the section 126 to a jump cut score 131 that is located between the automatic bottom panels 70 and 74. Slits 128 similar to slits 87 weaken the inclined edge section 127.

Last along the strip 80 is a seventh spacer panel 130 connected to the spacer panel 124 by the jump cut score 131, and connected to the automatic bottom panel 74 along a score 132. The panel 130 defines an inclined edge section 134 extending from the score 131. The edge section 134 is a mirror image of the edge section 127 of the panel 124. An arcuate edge section 135 extends from the section 134 to the right end of the strip 80, which meets the cut edge 77. The edge section 135 is a mirror image of the edge section 126 of the panel 124. Slits 136 similar to slits 87 weaken the inclined edge section 134.

It should be noted that the scores 83, 101, 118, and 132 are generally collinear.

Adhesive selected from types well know to those skilled in the art is applied at an appropriate time to several areas of the blank 10' to hold the carton 10 together. Adhesive 140 is applied to the outer side (that is, the side not showing in FIG. 1) of the spacer panel 130, and adhesive 142 is applied to the outer side of the spacer panel 98. Adhesive 144 is applied to the inner side of the glue flap 20.

Initial Assembly

The blank 10' is first assembled into an intermediate, broken down, flat carton 10" shown in FIG. 3. Those skilled in the art will understand that automatic gluing and folding machinery using known techniques may be constructed to carry out this assembly in a mass production setting, but is not required to make a carton embodying the present invention. The first step in this process is to fold the bottom closure 58 upwardly about the collinear scores 61,65,71,75 onto the inner surface of the side panels, as shown in FIG. 2. At this time, the adhesive areas 140, 142, and 144 are applied.

Next, the side panel 18 and associated bottom panel 74 and sparer panel 130 are folded about the scores 17 and 131 onto the side panel 16. This results in the spacer panel 130 adhering to the spacer panel 124. Finally, the side panel 12, bottom panel 60, spacer panels 82 and 90, and glue flap 20 are folded about scores 13 and 99 onto the side panel 14. This results in the spacer panel 98 adhering to the spacer panel 90, the glue flap 20 adhering to the outer surface of the side panel 18, with the score 21 aligned with the peripheral edge of the panel 18.

The resulting multi-layer flat assembly 10" is shown in FIG. 3. The automatic bottom panels 60,64,70,74 are now connected in such a way that when the carton 10" is erected into the carton 10, a floor will automatically be formed. The carton 10" occupies very little space and therefore may be shipped efficiently to a factory or other location at which the carton may be erected and loaded.

Erecting the Carton

The carton 10" of FIG. 3 may be erected by exerting inward pressure at the scores 13 and 17, causing the side panels to move apart and begin to form a sleeve having a rectangular or square cross section. Referring to FIG. 4, as this occurs, the bottom panels 60, 64, 70, 74 are drawn downward about scores 61, 65, 71, 75, respectively, because of the connection of the.spacer panels 124 and 130, as well as the connection of the spacer panels 90 and 98. During this process the spacer panels all retain their orientation parallel to the side walls, by folding about the scores 83, 101, 118, 132. The scores 91, 109, 125 all move toward the center of the sleeve being formed by the side panels.

As the scores 99 and 131 are drawn out of the corners defined at scores 13 and 17, along the side panels 12 and 16, the attached spacer panels 90,98 and 124,130 are forced to break, as at 147 and 146, respectively. Similarly, the spacer panel 108 is forced to break, in one or more places 148. However, as the bottom panels reach their final coplanar destination perpendicular to the side panels, the spacer panels straighten into a cross-like configuration as shown in FIG. 5. Now, the scores 99, 117 and 131, and the free end of the spacer panel 82, stand vertically adjacent to the side panels 12, 14, 16, and 18, respectively. The spacer panels extend from the floor of the carton axially into the carton 10, generally perpendicular to the bottom of the carton.

The arcuate edge sections 85, 93, 104, 111, 121, 126,135 all meet at the center of the carton sleeve and slope toward the bottom as they extend away from the center. Then the inclined edge sections 84, 94, 103, 112, 120, 127, 134 slope farther into the carton until they meet the side panels. The weakening slits 87,97,105,113,122,128,136 are spaced a short distance in from the side panels. Six of the spacer panels form double thick arms 90/98, 108/116, and 124/130 of the cross, while the fourth arm is the single thickness of the spacer panel 82. As shown, the spacer panels define a two-dimensional platform capable of supporting an object spaced above the bottom or floor of the carton 10.

Figure 13:
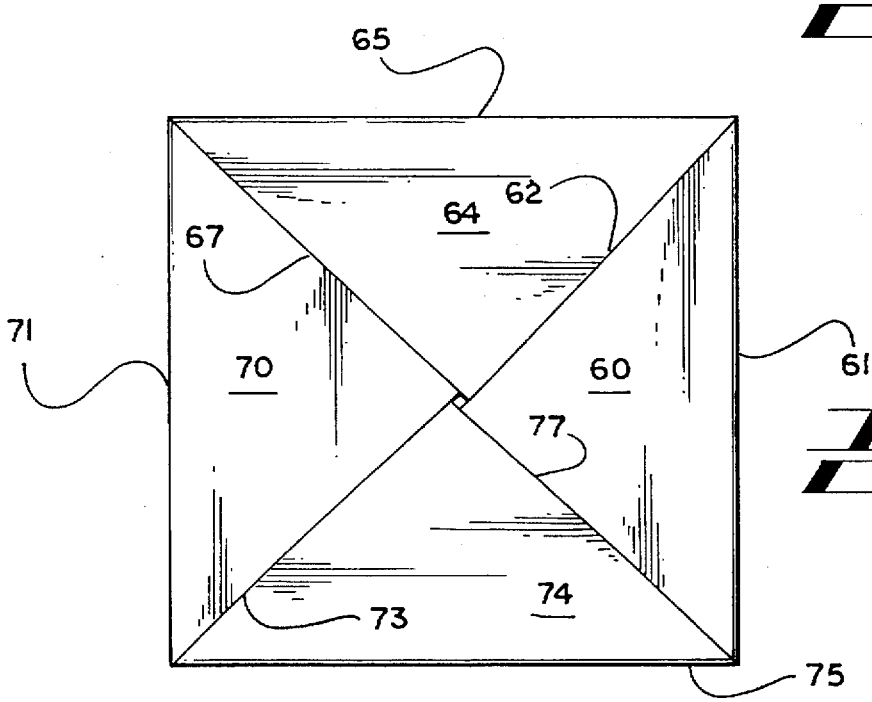
FIG. 13 is a bottom plan view of the erected carton.

FIG. 13 shows the exterior of the bottom of the erected carton 10. While the carton shown is square in cross section, it will be understood that the invention may be embodied in a rectangular carton.

Loading and Closing the Carton

The carton 10 is now ready for loading. The platform formed by the spacer panels is well suited for receiving a flat-bottomed article large enough so that its bottom edges rest on the inclined edge sections of the spacer panels. The slope of these edge sections helps to center the article, and also to prevent the article from moving toward the side panels. FIG. 5 shows a cylindrical article 160, such as an air filter, in dashed lines resting on the spacer panels. If the article has a downwardly opening cavity, such as a central cavity passing entirely through a cylindrical filter, the hump created by the arcuate edge sections may extend up into the cavity. This again helps to center the article, and prevent the article from moving toward the side panels.

Figure 6:
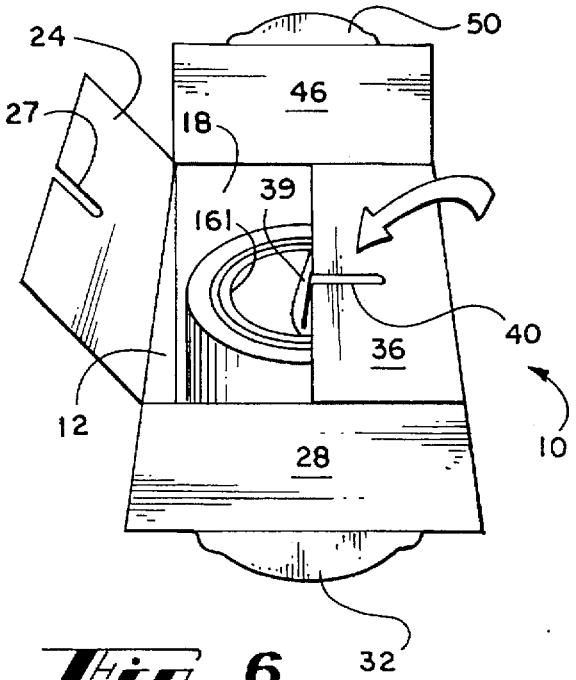
FIG. 6 is a partial pictorial view of the top end of the carton showing a first step in closing the cover panels.
Figure 11:
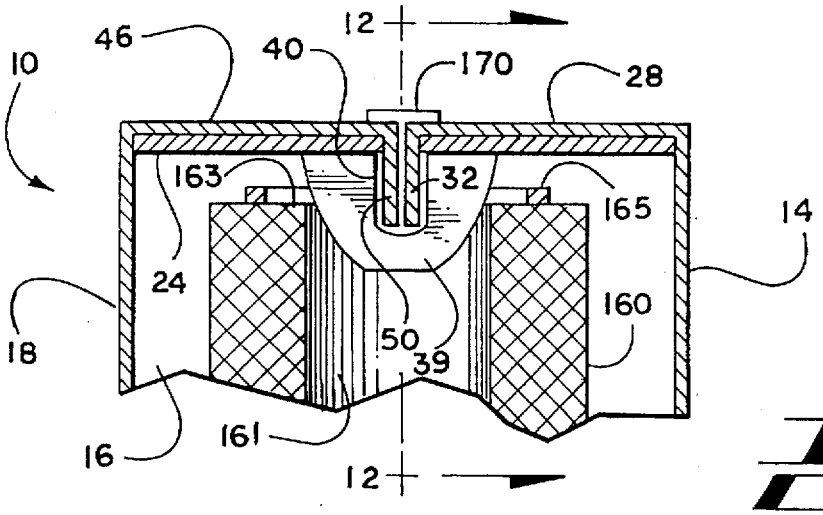
FIG. 11 is a partial side cross sectional view taken along line 11—11 of FIG. 9.

The flaps of the top closure 23 have remained vertical, or may have been folded outwardly to facilitate loading of the article 160. The process of closing the carton 10 is shown in FIGS. 6–9. To begin closing the carton, the mandrel panel 39 is folded inwardly about the score 41, and then the inner cover flap 36 is folded about the score 37 until it lies across a portion of the open end of the carton. The result is shown in FIG. 6. In the case of an article 160 having an upwardly opening cavity 161 (as shown in FIG. 5 and FIG. 11), the mandrel panel 39 extends into the cavity. Preferably the width of the panel 39 is approximately equal to the width of the cavity, so that the panel prevents significant lateral movement of the article along a path parallel to the plane of the panel 39, as shown in FIG. 11. The cut lines 42 allow the panel 39 to penetrate a greater distance into the cavity if needed, if the height of the article being packed is at the shorter end of the range of article accommodated by the particular carton, or if the inside diameter of the cavity is large.

Figure 7:
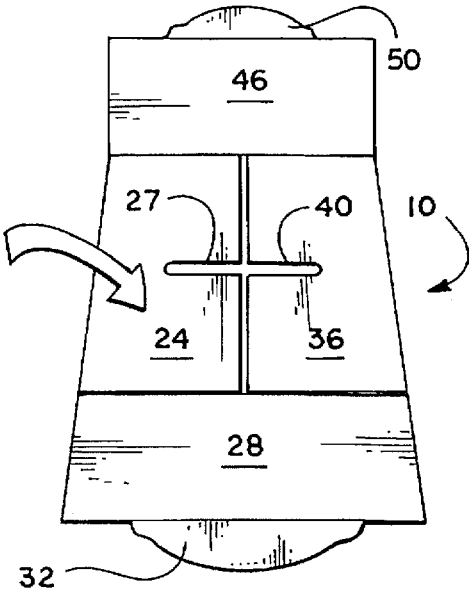
FIG. 7 is a partial pictorial view of the top end of the carton showing a second step in closing the cover panels, resulting in alignment of slots in the closed inner cover panels.
Figure 8:
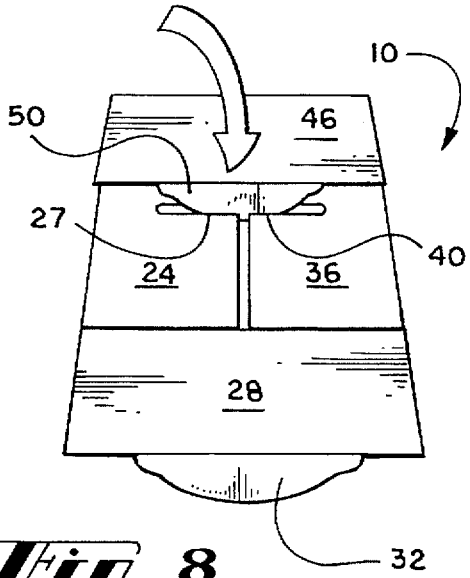
FIG. 8 is a partial pictorial view of the top end of the carton showing a third step in closing the cover panels, namely, the insertion of one of the clamping panels.
Figure 9:
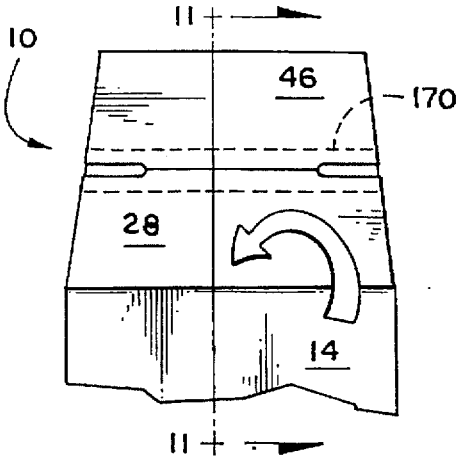
FIG. 9 is a partial pictorial view of the top end of the carton showing a fourth step in closing the cover panels, namely, the insertion of the final clamping panel and taping to ready the package for shipping.

Next, the other inner cover panel 24 is folded about the score 25, as shown in FIG. 7, until it lies approximately in the same plane as the inner cover panel 36, with their free edges meeting at the center of the carton, and with the slots 27 and 40 aligned. Then, as shown in FIG. 8, the clamping panel 50 is folded inwardly about the score 53, and the outer cover flap 46 is folded about the score 47 until the clamping panel 50 enters the collinear slots 27,40. The outer cover flap 28 is similarly folded about the score 29 to insert the clamping panel 32 into the slots 27, 40 adjacent to the clamping panel 50, as shown in FIG. 9. The portion of the slot 40 in the mandrel panel 39 accommodates the clamping panels 32 and 50, as best shown in FIG. 11. Finally, pressure is applied to the cover flaps to press the clamping panels against the article, and a strip of tape 170 (shown in dashed lines in FIG. 9) is applied along the joint between the cover panels 28 and 46 to secure the top closure. It will be understood that the order of closure of the two inner flaps 24, 36, and the order of closure of the two outer flaps 28, 46 is not critical.

It should be understood that automatic closing and taping machinery using known techniques may be constructed to close the flaps 24, 28, 36, and 46 and to apply the tape 170 in a mass production setting, but is not required to close and secure a carton embodying the present invention.

Figure 10:
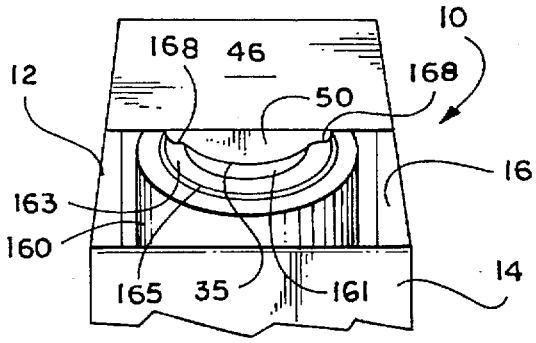
FIG. 10 is partial pictorial view of the top end of the carton with parts broken away to show the relationship of a clamping panel with a cylindrical object in the carton.
Figure 12:
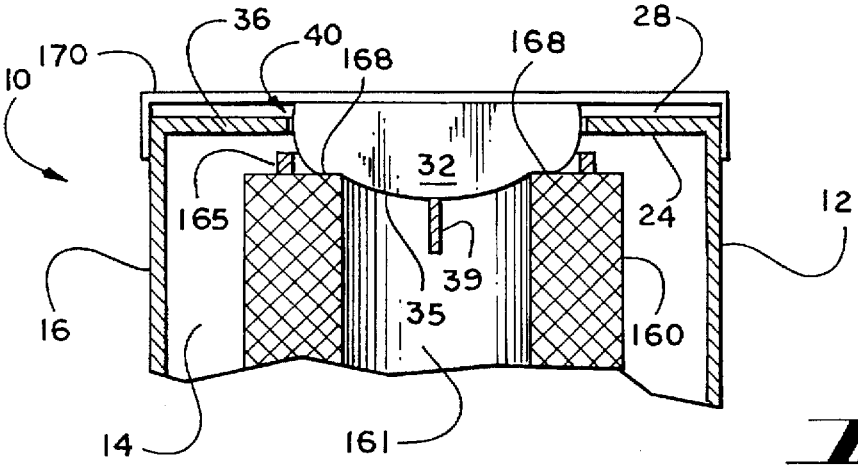
FIG. 12 is a partial side cross sectional view taken along line 12—12 of FIG. 11.

The configuration of the clamping panel 50 after closure is shown in FIG. 10 and, and the similar configuration of the clamping panel 32 is shown in FIG. 12. The particular article 160 shown is an air filter defining a central cavity 161, a ledge 163 surrounding the cavity, and an annular gasket 165 attached to the end of the filter around the ledge 163. It is important that the fragile filter be held away from the side panels of the carton. It also is important that the gasket 165 not be damaged. Therefore, the clamping panels 32, 50 are constructed so that their width allows them to pass inside the gasket 165 while still engaging the ledge 163 at pressure points 168.

When pressure is exerted on the cover flaps, the material of the clamping panels tends to deform somewhat at the pressure points 168, as shown in FIGS. 10 and 12. At the same time, the convex edge 35 of the clamping panels enters the cavity 161. Thus, the clamping panels tend to lock into the cavity of the article and prevent it from moving laterally along a path parallel to the plane of the clamping panels, as well as spacing the article away from the cover panels of the carton. Because the mandrel panel inhibits lateral movement in a plane perpendicular to the clamping panels, the cone or mandrel formed by the crossed panels extending into the cavity 161 effectively prevents lateral movement of the article. This structure is best seen in FIG. 5.

Furthermore, the axial clamping pressure of the clamping panels presses the article into the spacer panels below. These panels also tend to deform, particularly at the weakening slits. This allows the article to bite into the inclined edge sections of the spacer panels to inhibit or prevent lateral movement of the bottom of the article. Thus, the article tends to become centered and remains centered and spaced away from the sides of the carton. There need not be a central cavity at the bottom of the article, but if such a cavity is present (such as in a cylindrical article with an axial opening extending completely through the cylinder) the hump formed by the arcuate edge sections 85,93,104,111,121,126, and 135 may enter the cavity somewhat to assist in centering and holding the article.

The compressibility of the spacer panels, particularly in the areas of the weakening slits 87,97,105,113,122,128,136, allows the carton to adjust to articles of different heights. Therefore, a particular carton embodying the invention can be used for articles within a range of heights.

It should further be understood that a variety of cylindrical diameters may be accommodated by a single carton having spacer, mandrel and clamping panels as shown. This flexibility arises from the shape of the inclined edge sections of the spacer panels, and the convex edge 35 of the clamping panels. Within a range of diameters, the outer edge of the bottom of the cylinder will rest at a different place along the inclined edges depending on the diameter, and still be prevented by the slope from lateral movement after pressure is applied. Such flexibility leads to large savings over a packaging system in which a custom size carton is required for every size article.

It should also be understood that the principles of the present invention can be applied to protectively package articles having various shapes. For example, a sphere may be packaged by forming the spacer panels to create a concave platform at the bottom of the carton, and by shaping the clamping panels and the mandrel panel to have concave edges. When properly dimensioned for a particular sphere or range of spherical sizes, the spheres would be held firmly and held spaced apart from walls of the carton. Likewise, the spacer, mandrel and clamping panels may be custom shaped to fit over or into uniquely shaped articles to hold them in place within the carton.

A carton 210 providing a second embodiment of the present invention may be constructed from a blank 210' shown in FIG. 14. The blank 210' has many elements in common with the blank 10', but differs in the shape of its top closure 223 and the shape of its strip 280 of spacer panels. The carton 210 is designed for cylindrical objects with relatively small central openings, such as a filter 260, shown in FIG. 15.

The top closure 223 is formed from a pair of inner cover flaps 224 and 236, and a pair of outer cover flaps 228 and 246. The inner cover flap 224, foldably connected to the side wall panel 12, is similar to the cover flap 24 of the first embodiment, but has a somewhat shorter slot 227, and a pair of cut lines 225 extending into the flap 224 from a distal edge. Each cut line 225 is positioned spaced a short distance in from one side of the flap 224, and extends parallel to the slot 227. The other inner flap 236 includes a pair of side spacer tabs 238 projecting beyond a distal edge 237 of the flap at each side of the flap. The tabs 238 are foldably connected to the body of the flap 236 by jump cut scores 239. At the inner edges of the tabs 238, cut lines 242 extend into the flap 236 in the same configuration as the cut lines 225 of the flap 224. A slot 240 is provided in the flap 224 aligned with the slot 227.

Along the distal edges of the outer cover flaps 228 and 246, a clamping panel 232 is foldably connected along a jump cut score 234. Each of the clamping panels 232 is formed in the shape of a "T" with a cross bar portion 231 attached along the score 234 and a tapering stem portion 235 extending outwardly away from the flap 228 or 246.

The strip 280 of spacer panels is attached to the automatic bottom panels in a manner similar to that described above for the first embodiment so as to form a cross within the erected carton. A spacer panel 282 is attached to the automatic bottom panel 60. The spacer panel 282 defines a tapered projection 285 at its rightmost end as seen in FIG. 14. A spacer panel 290 is connected to the panel 282 by a score 291, and defines a tapered projection 293, which is a mirror image of the projection 285, adjacent to the score 291. It will be seen that the edges of the panels 282 and 290 extending away from the projections are straight, and will be horizontal within the erected carton.

Thereafter, along the strip 280, additional pairs of spacer panels 282 and 290 are provided, one pair attached to the automatic bottom panel 64 and the next attached to the automatic bottom panel 70. Finally, a single panel 282 is connected to the automatic bottom panel 74. Those skilled in the art will understand that the spacer panels of the strip 280 will form a cross-shaped platform of the type shown in FIG. 5. However, the projections 285 and 293 will extend upwardly into a central opening 261 of the cylindrical article 260. Also, in contrast to the arcuate and inclined edge sections of the strip 80 of the first embodiment, the upwardly facing edges of the spacer panels 282 and 290 are straight and horizontal except at the projections.

When the cylindrical article 260 is set down onto the spacer panels of the carton 210, the small inner opening 261 fits over the projections 285 and 293 until the interior of the opening engages the tapering sides of the projections and the body of the article rests on the flat edges of the spacer panels. In this embodiment, lateral movement of the article is prevented by the projections. This embodiment is particularly useful for filters with small central openings, for example, a filter with a central opening having a diameter of 1 to 1.5 inches (2.5 to 3.75 cm).

The top closure 223 is closed first by folding in the inner flaps 224 and 236, as shown in FIG. 16. The tabs 238 are first folded at right angles to the flap 236 so that when the flap 236 is folded over the carton, the tabs extend axially into the carton on each side of the cylindrical article 260. To prevent lateral movement of the article, the distance between the tabs 238 is selected to be just larger than the outside diameter of the article. The slots 227 and 240 align as previously described, and the corresponding cut lines 225 and 242 align.

Then the outer cover flaps 228 and 246 are folded down to a configuration shown in FIG. 15. The stem portions 235 of the clamping panels 232 extend through the slots 227, 240 and enter the central opening 261 of the article until the tapering edge of the stem portion engages the interior of the opening 261. In this embodiment, the cross bar portion 231 of the clamping panel 232 is longer than the combined length of the slots 227, 240. Therefore, the cross bar portion engages the flaps 224 and 236 at shoulders 233 and presses the portion of the flaps between the cut lines 225 and 242 down onto the top of the article 260, as shown in FIG. 15. Downward pressure on the top closure causes some deformation of the clamping panels 232 and the projections 295, 293 of the spacer panels, resulting in the article 260 being snugly and securely held within the carton 210, spaced inwardly from all the outer walls of the carton.

A modification of the spacer panels of the carton 210 is shown in FIG. 17. Here, spacer panels 302 form a set of projections 304 at the center of the carton bottom. The projections 304 may extend up into a central opening of an article as described in connection with the projections 285, 293. However, the spacer panels 302 also include inclined outer edges with weakening slits 87, of the type included in the first embodiment. Thus, this spacer panel platform 301 can accommodate either an article with a small central opening, or a larger article whose bottom would rest on and deform the inclined edges of the spacer panels 302 in the manner described above.

A carton providing a third embodiment of the present invention may be constructed from a blank 310 shown in FIG. 18. The blank 310 has many elements in common with the blank 10', but differs in the shape of its strip 380 of spacer panels. Its top closure includes clamping panels 332 foldably connected to outer cover flaps 28 and 46 along jump cut scores 353. The clamping panels 332 have a more complex distal edge that the clamping panels 32, providing steps 368 and 369 near the ends of the panels 332. The steps 368 may rest on the ledge surrounding the central cavity of a filter or the like, and the step 369 may accommodate a gasket around the upper end of the filter.

A spacer panel 382 is connected to the automatic bottom panel 60. The panel 382 defines a notch 383 in a flat edge section 384, followed by an inclined edge section 385. A spacer panel 390 is connected to the panel 382 by a score 391, and provides a mirror image of the panel 382, namely, an inclined edge 393, and notch 395 in a flat edge section 494. As in previous embodiments, these panels 382 and 290 repeat themselves along the strip 380, ending in a single panel 382 attached to the automatic bottom panel 74. Those skilled in the art will understand that the blank 310 will form into a carton in the same way as the other embodiments. However, the notches 383, 395 will be found in all of the spacer panels at the same distance from the center of the cross-shaped platform. The purpose of the notches is to accommodate a filter with an annular gasket around the bottom surface of the filter. The width and depth of the notches is selected based on the size of the gasket. As an example, notches 1 inch (2.5 cm) wide and one-half inch (1.25 cm) deep may be appropriate for the gaskets of some filters. Thus, the bottom of the filter can be urged against the platform of spacer panels without deforming or damaging the gasket. It will be seen that the carton embodiment of FIG. 18 is suited to pack filters that have annular gaskets on both ends of the filter.

What is claimed is:

1. A carton, comprising:

a top closure;

a plurality of side panels;

a plurality of auto-bottom panels each foldably connected to a bottom edge of one of said side panels; and a plurality of spacer panels foldably connected to at least some of said auto-bottom panels;

said top closure comprising:

a first inner cover flap extending from a first side panel to define a distal edge part way across an open end of said carton, and defining a first slot therein intersecting said distal edge;

a second inner cover flap extending from a second side panel to a position adjacent to said distal edge of said first inner cover flap;

an inner mandrel panel foldably connected to said second inner cover flap, and adapted to be folded into said carton where said inner cover flaps meet;

a second slot beginning in said inner cover flap and continuing into said inner mandrel panel, said second slot being coplanar with said first slot;

an outer cover flap foldably connected to a third one of said side panels; and an outer clamping panel foldably connected along a distal edge of said outer cover flap;

said outer cover flap being foldable over said inner cover flaps with said outer clamping panel extending through said first and second slots and generally axially into the portion of said second slot defined in said inner mandrel panel;

such that when said carton is erected, said auto-bottom panels form a generally planar bottom of said carton, and said spacer panels extend generally axially into said carton from said bottom to form a two-dimensional support base for holding an object at a location spaced above the bottom of said carton, said carton being substantially unobstructed above said support base inside said carton when said top closure is opened, and said spacer panels defining a cross having an intersection point spaced inwardly from all of said side panels.

2. The carton of claim 1, further comprising a second outer cover flap foldably connected to a fourth side panel, and defining a second outer clamping panel foldably connected thereto, said two outer clamping panels being together received in said first and second slots of said inner cover flaps.

3. The carton of claim 2, wherein said spacer panels and at least some of said clamping panels are adapted to be pressed into said object and partly axially deformed by contact with the object when said carton is closed.

4. The carton of claim 1, wherein said spacer panels are inclined from a shortest height at the intersection point of said cross to a highest height adjacent to said side walls.

5. The carton of claim 4, wherein said spacer panels include a weakened area spaced inwardly from said side walls and facing an opposite end of said carton.

6. The carton of claim 5, wherein said weakened area comprises a pair of spaced apart axially slits cut into said spacer panels.

7. The carton of claim 1, wherein said spacer panels define a projection extending axially upward into said carton at the intersection point of said cross.

8. The carton and object of claim 2, wherein said clamping panels each comprise an elongate portion foldably connected to said outer cover flaps, said elongate portion being longer than the combined length of said first and second slots; and a stem portion extending from said elongate portion to engage said cavity edge, said elongate portion urging said inner cover flaps toward the outer surface of said object.

9. The carton of claim 1, wherein one of said inner cover flaps defines a pair of side spacer tabs foldably connected to said inner cover flap at opposite ends thereof, and adapted to be folded into said carton on opposite sides of said object, so as to laterally retain said object between said spacer tabs.

10. A carton for packing an object, comprising:

a plurality of side panels;

a plurality of auto-bottom panels each foldably connected to edges of said side panels at a bottom end of said carton;

a plurality of spacer panels foldably connected to at least some of said auto-bottom panels;

such that when said carton is erected, said auto-bottom panels form a generally planar bottom of said carton, and said spacer panels extend generally axially into said carton from said bottom, said spacer panels defining a cross having an intersection point spaced inwardly from all of said side panels;

at least one end cover flap foldably connected to at least one of said side panels at a top end of said carton; and a clamping panel foldably connected to said top end cover flap, said clamping panel defining a distal edge for engaging said object;

said top end cover flap being foldable over said top carton end with said clamping flap extending into said top end of said carton to engage said object and hold said object against said opposite spacer panels.

11. A carton in combination with an object retained therein, said carton comprising:

a plurality of side panels;

a plurality of bottom panels each foldably connected to a bottom edge of one of said side panels;

a plurality of spacer panels foldably connected to at least some of said bottom panels, such that when said carton is erected, said bottom panels form a generally planar bottom of said carton, and said spacer panels extend generally axially into said carton from said bottom to form a two-dimensional support base for holding said object at a location spaced above the bottom of said carton, each of said spacer panels defining an inclined portion sloping toward said bottom panels from a location adjacent to one of said side panels to a location intermediate said side panels; and a top closure foldably connected to one or more of said side panels for enclosing an end of said carton opposite said bottom, said top closure including a closure panel and a clamping member extending into said carton inwardly from the plane of said closure panel, such that when said carton is closed, said clamping member is urged against said object within said carton, to hold said object spaced inwardly from said closure panel and firmly against said inclined portions of said spacer panels.

12. The carton and object of claim 11, wherein said spacer panels and said clamping member are shaped to engage said object so as to prevent significant lateral movement thereof within said carton.

13. The carton and object of claim 11, further comprising a plurality of slits formed in said inclined portions of each of said spacer panels, said slits allowing said spacer panels to deform under pressure from said object.

14. The carton of claim 10, wherein said clamping panel is connected to a first top end cover flap, and further comprising a second top end cover flap foldably connected to another of said side panels, said second top cover flap defining a pair of side spacer tabs foldably connected to said second top cover flap at opposite ends thereof, and adapted to be folded into said carton on opposite sides of said object, so as to laterally retain said object between said spacer tabs.

15. The carton of claim 11, further comprising a second closure panel foldably connected to one of said side panels, said second closure panel defining a pair of side spacer tabs foldably connected to said second closure panel at opposite ends thereof, and adapted to be folded into said carton on opposite sides of said object, so as to laterally retain said object between said spacer tabs.

16. A carton for packing an object, comprising:

first, second, third, and fourth side panels sequentially adjacent to one another and foldably connected by score lines to form a sleeve;

first, second, third, and fourth bottom panels, connected to respective side panels at a bottom end of said carton;

a continuous strip panel foldably connected to each of said bottom panels, said strip being divided by fold lines into a seven spacer panels:

a first spacer panel foldably connected to said first bottom panel;

a second spacer panel foldably connected to said first spacer panel;

a third spacer panel foldably connected to said second bottom panel and to said second spacer panel;

a fourth spacer panel foldably connected to said third spacer panel;

a fifth spacer panel foldably connected to said third bottom panel and to said fourth spacer panel;

a sixth spacer panel foldably connected to said fifth spacer panel; and a seventh spacer panel foldably connected to said fourth bottom panel and to said sixth spacer panel;

said seventh spacer panel being adhesively connected to said sixth spacer panel, and said third spacer panel being adhesively connected to said second spacer panel, such that when said carton is erected, said strip panel causes said bottom panels to form a generally planar bottom of said carton, and said spacer panels extend generally axially into said carton from said bottom;

said spacer panels defining inwardly facing edges shaped to engage an article to be packed in said carton;

at least one end cover flap foldably connected to at least one of said side panels at a top end of said carton; and a clamping panel foldably connected to said top end cover flap, said clamping panel defining a distal edge for engaging said object;

said top end cover flap being foldable over said top carton end with said clamping flap extending into said top end of said carton to engage said object and hold said object against said opposite spacer panels.

17. A container formed from a single blank of foldable sheet material, comprising:

first, second, third, and fourth side panels sequentially adjacent to one another and foldably connected by score lines to form a sleeve;

first, second, third, and fourth bottom panels, connected to respective side panels at a bottom end of said carton;

a continuous strip panel foldably connected to each of said bottom panels, said strip being divided by fold lines into a seven spacer panels:

a first spacer panel foldably connected to said first bottom panel;

a second spacer panel foldably connected to said first spacer panel;

a third spacer panel foldably connected to said second bottom panel and to said second spacer panel;

a fourth spacer panel foldably connected to said third spacer panel;

a fifth spacer panel foldably connected to said third bottom panel and to said fourth spacer panel;

a sixth spacer panel foldably connected to said fifth spacer panel; and a seventh spacer panel foldably connected to said fourth bottom panel and to said sixth spacer panel;

said seventh spacer panel being adhesively connected to said sixth spacer panel, and said third spacer panel being adhesively connected to said second spacer panel, such that when said carton is erected, said strip panel causes said bottom panels to automatically form a generally planar bottom of said carton.

18. The container of claim 17, wherein said spacer panels include a first spacer panel extending in a first direction, and a second spacer panel extending in a second direction not parallel to said first direction.

19. A carton, comprising:

a top closure;

a plurality of side panels;

a plurality of auto-bottom panels each foldably connected to a bottom edge of one of said side panels; and a plurality of spacer panels foldably connected to at least some of said auto-bottom panels; and a top closure comprising:

at least one inner cover flap foldably connected to one of said side panels opposite from said carton bottom, said inner cover flap being foldable over an end of said carton, and defining a slot therein at a location spaced inwardly from said side walls;

at least one outer cover flap foldably connected to another one of said side panels; and a clamping panel foldably connected along a distal edge of said outer cover flap;

said outer cover flap being foldable over said inner cover flap with said clamping flap extending through said slot and generally axially into said end of said carton;

such that when said carton is erected, said auto-bottom panels form a generally planar bottom of said carton, and said spacer panels extend generally axially into said carton from said bottom to form a two-dimensional support base for holding an object at a location spaced above the bottom of said carton, said carton being substantially unobstructed above said support base inside said carton when said top closure is opened, and said spacer panels defining a cross having an intersection point spaced inwardly from all of said side panels.

20. The carton of claim 19, wherein said spacer panels and said clamping flap are sized to be urged against opposite ends of said object within said carton when said carton is closed, to hold the object therebetween.

* * * * *